US005182812A

United States Patent [19]

Goldsby

[11] Patent Number: 5,182,812

[45] Date of Patent: Feb. 2, 1993

[54] LAYERED REDUCING GARMENT

[76] Inventor: Irma J. Goldsby, 1710 N. 42nd St., E. St. Louis, Ill. 62204

[21] Appl. No.: 676,378

[22] Filed: Mar. 28, 1991

[51] Int. Cl.[5] ..... A41D 13/00

[52] U.S. Cl. ..... 2/79; 2/51; 2/69; 2/84; 2/227; 128/363

[58] Field of Search ..... 2/2, 69, 69.5, 75, 79, 2/80, 81, 84, 107, 117, DIG. 6, DIG. 7, 202, 227; 128/363

[56] References Cited

U.S. PATENT DOCUMENTS

| | | | |
|---|---|---|---|
| 1,489,046 | 4/1924 | Thompson | 2/DIG. 7 X |
| 2,087,763 | 7/1937 | Liebmann | 2/70 |
| 2,372,110 | 3/1945 | Noone | 2/84 |
| 2,562,061 | 7/1951 | Peterson | 2/69.5 |
| 2,621,336 | 12/1952 | Wendroff | 2/80 X |
| 2,709,667 | 5/1955 | Grubb et al. | 2/2 X |
| 2,994,089 | 1/1961 | Ferguson et al. | 2/269 |
| 3,425,060 | 2/1969 | Glaser et al. | 2/81 X |
| 3,803,640 | 4/1974 | Ericson | 2/DIG. 7 X |
| 3,945,042 | 3/1976 | Lobo | 2/2 |
| 4,033,354 | 7/1977 | De Rosa | 128/402 X |
| 4,034,417 | 7/1977 | Ellis | 2/81 |
| 4,308,622 | 1/1982 | Maddron | 2/269 |
| 4,407,497 | 10/1983 | Gracie | 2/67 |
| 4,426,740 | 1/1984 | Reverberi | 2/84 |
| 4,502,153 | 3/1985 | Lapedes et al. | 2/81 |
| 4,604,759 | 8/1986 | Bowman et al. | 2/81 |
| 4,766,613 | 8/1988 | Wells | 2/DIG. 6 X |
| 4,823,404 | 4/1989 | Morell et al. | 2/79 X |
| 4,884,298 | 12/1989 | Silas | 2/49 R |
| 4,932,078 | 6/1990 | Jones et al. | 2/84 X |
| 5,005,216 | 4/1991 | Blackburn et al. | 2/79 |
| 5,007,112 | 4/1991 | Lewis, Jr. et al. | 2/79 |
| 5,018,521 | 5/1991 | Campbell | 128/363 |
| 5,048,125 | 9/1991 | Libertini et al. | 2/79 |
| 5,097,534 | 3/1992 | Viemeister et al. | 2/84 X |

FOREIGN PATENT DOCUMENTS

| | | | |
|---|---|---|---|
| 1129431 | 5/1958 | Fed. Rep. of Germany | 2/2 |
| 1291012 | 3/1962 | France | 2/DIG. 6 |
| 1408827 | 7/1965 | France | 2/DIG. 6 |
| 2433913 | 4/1980 | France | 2/227 |
| 2467557 | 5/1981 | France | 2/79 |

OTHER PUBLICATIONS

Geishman, Maurice "Self Adhering Nylon Tapes." The J.A. MA, vol. 168, No. 7, Oct. 1958.

*Primary Examiner*—Werner H. Schroeder
*Assistant Examiner*—Jeanette E. Chapman
*Attorney, Agent, or Firm*—Jacobson, Price, Holman & Stern

[57] ABSTRACT

A garment adapted to be worn by individuals to assist in weight reduction by reducing body fat. The garment is constructed in various sizes for use by various sized individuals and constructed in a model for use by males and a model for use by females. The garment includes readily attachable and detachable components to facilitate use of the garment and to enable certain portions of the human anatomy to be reduced while other portions are not. The garment is constructed of three layers of material with the inner layer being an absorbent fabric such as cotton, the middle or central layer being a flexible moisture impervious sheet such as vinyl and the outer layer being an attractive, breatheable and elastic-type fabric material such as terry cloth or other wash and wear fabric materials with the garment being launderable and effective for maintaining body heat which assists in reduction of body fat during exercise periods and the like.

1 Claim, 1 Drawing Sheet

LAYERED REDUCING GARMENT

BACKGROUND OF THE INVENTION

1. Field of the Invention

The present invention generally relates to a layered reducing garment completely or partially enclosing the human body except for the face, hands and feet with certain of the components such as the legs, sleeves and hood on the garment being easily attached and detached to render the garment universal in use in reducing body fat by retaining body heat interiorly of the garment while it is being worn. The garment includes an inner layer of absorbent fabric, a middle layer of flexible vinyl and an outer layer of fabric material such as terry cloth or the like.

2. Description of the Prior Art

Various types of garments have been provided for use by individuals when jogging, exercising and the like which are quite attractive and capable of general utility. Such garments are usually relatively loose fitting and constructed of stretchable material to enable freedom of movement of the person wearing the garment. Also, there have been provided garments or partial garments constructed of air impervious and moisture impervious material but such garments usually cling to the surface of the skin due to perspiration which produces an objectionable clammy feeling and such garments are also relatively unattractive and usually are not worn in public.

The following patents are exemplary of the development of the state of the art relating to this invention:

| | |
|---|---|
| 2,020,155 | Nov. 5, 1935 |
| 2,543,327 | Feb. 27, 1951 |
| 3,858,028 | Dec. 31, 1974 |
| 3,999,037 | Dec. 21, 1976 |
| 4,117,552 | Oct. 3, 1978 |
| 4,195,364 | Apr. 1, 1980 |

SUMMARY OF THE INVENTION

An object of the present invention is to provide a garment constructed of layers of material stitched or otherwise secured together in superimposed contacting relation and consisting of an inner layer of flexible, soft, absorbent fabric such as cotton, an outer layer of attractive, flexible, preferably elasticized fabric such as terry cloth or the like and a middle layer of flexible, air impervious, moisture impervious plastic sheeting or material such a vinyl with all of the layers of material being capable of stitching or sewing in a conventional manner and easily launderable.

Another object of the invention is to provide a garment in accordance with the preceding object specifically provided for reducing body fat by retaining body heat interiorly thereof when the garment is worn during periods of exercise or at other times with the external appearance characteristic of the garment being attractive to enable the garment to be worn in public as well as in private during exercise periods and the like.

A further object of the invention is to provide a layered reducing garment having detachable components such as the hood, sleeves and legs and separate upper and lower components constructed in a manner especially adapted for use by females or in a manner especially adapted for use by males and of varying sizes to enable universal utility of the garment.

Still another object of the invention is to provide a layered reducing garment with the preceding objects in which certain components of the garments are provided with knitted end portions for closely encircling the wrists, ankles, neck and waist area of the wearer for retaining body heat with the detachable components enabling certain extremities of the human anatomy to be exposed outside of the garment so that only certain areas of the body may be reduced if desired.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
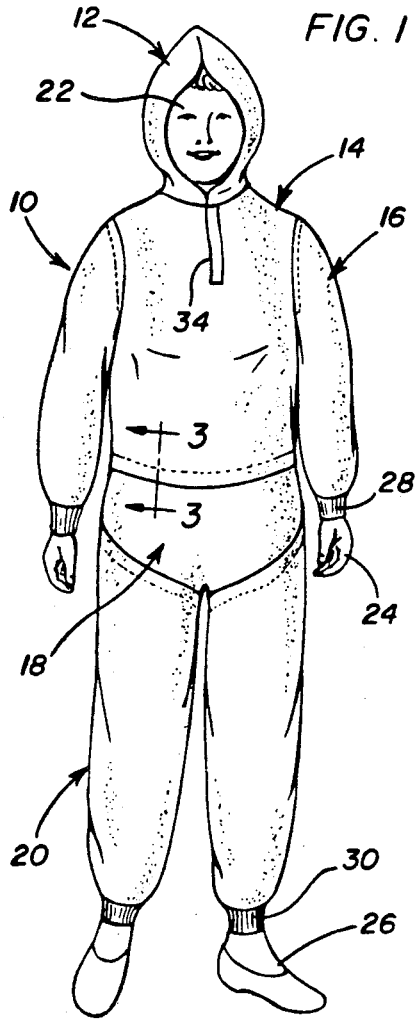
FIG. 1 is a perspective view of the layered reducing garment of the present invention illustrating all of the components in assembled relationship.
Figure 2:
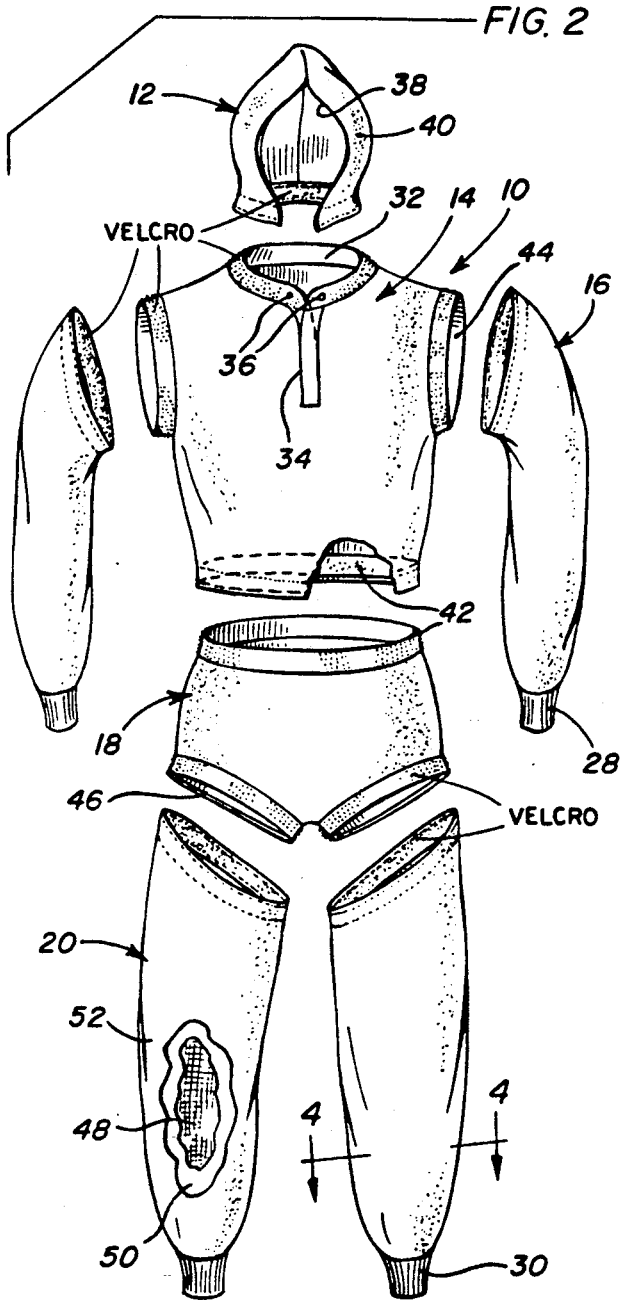
FIG. 2 is a perspective view of the garment with all of the separable components oriented in separated relation with a portion of one of the legs broken away to illustrate the layered construction.

Referring now specifically to the drawings, the layered reducing garment of the present invention is generally designated by the numeral 10 and includes a hood 12, a jacket or upper torso covering portion 14 with detachable sleeves 16 and a pants portion or lower portion 18 having detachable legs 20 so that when all of the components of garment 10 are assembled and worn, all of the body of the person wearing the garment will be covered except for face 22, hands 24 and feet 26. The hands and feet can be covered by gloves and footwear if desired or may be left exposed. The outer end of each sleeve 16 is provided with an elasticized knitted cuff 28 and likewise, the lower end of each leg is provided with a similar cuff 30 for snugly embracing the wrist and ankle areas respectively and the upper end of the jacket or upper portion 14 is provided with a neck opening 32 defined by a neck band of knitted material to snugly enclose the neck area. Extending downwardly from the front of the neck opening or neck band 32 is a slit opening 34 closed by overlapping flaps and secured at its upper end in overlapping relation by a snap fastener arrangement 36 or equivalent fastening device.

The hood 12 includes an open area 38 which exposes the face 22 as illustrated in FIG. 1 and the bottom edge of the hood 12 includes a band 40 with the interior of the band 40 and the exterior of the neck band 32 being provided with coacting hook and loop pile fastener material 42 such as that is available under the trademark "VELCRO" to enable easy attachement and detachment of the hood. Likewise, the jacket 18 is provided with an arm opening 44 at each shoulder with the exterior surface thereof and the interior surface of the upper end of the sleeve 16 being provided with fastener material similar to 42. The pants portion 18 is provided with a leg opening 46 having the exterior periphery joined to the interior of the upper end of the leg 20 by fastener material similar to 42. The lower end of the jacket 18 and the upper end of the pants portion overlap each other with the inner surface of the lower end of the jacket 14 and the outer surface of the upper end of the pants portion 18 being connected with hook and loop pile fastener material 42. The use of hook and loop pile fastener material or equivalent fasteners to secure the top portion 14 and bottom portion 18 together is optional inasmuch as a bulky knitted waist portion can be incorporated into the pants portion 18 and into the lower end of the jacket or upper portion 14 to retain these components in overlapping relation when the garment is worn. Also, the jacket 14 may be constructed with the sleeves 16 integrally attached thereto and likewise, the pants 18 can be provided with permanent legs 20 if desired. Also, the pants portion 18 may be provided with a slit-like opening closed by overlapping flaps and a snap similar to that used at the neck opening of the jacket 14 so that this form of the invention can be more expediently used by male wearers.

Figure 3:
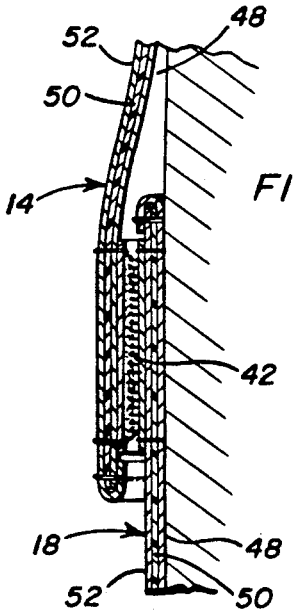
FIG. 3 is a fragmental sectional view, on an enlarged scale, taken along section line 3—3 on FIG. 1 illustrating the layered construction and the fastener assembly between the upper and lower portions of the garment.
Figure 4:
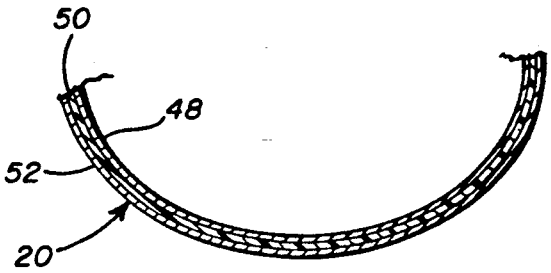
FIG. 4 is a fragmental sectional view, on an enlarged scale, taken substantially upon a plane passing along section line 4—4 on FIG. 2 illustrating further structural details of the layered construction of the reducing garment of the present invention.

FIG. 3 illustrates the relationship of the strips of hook and pile loop fastener material and preferably, the soft loop pile is on the external surface of the garment portions whereas the harder hooks are on the internal surfaces of the removable components so that when the components are removed, the soft pile will be left on that portion of the garment being worn.

The garment 10 is constructed of three layers of material including an inner layer 48, a middle layer 50 and an outer layer 52 with the inner layer 48 preferably being an absorbent fabric such as cotton and may be either lightweight or heavyweight such as cotton material used in the construction of T-shirts or similar undergarments. Other types of launderable absorbent fabrics may be used which are comfortable when in contact with the skin surface. The middle layer 50 is a flexible vinyl material which is air and moisture impervious and also launderable and capable of being secured to the other layers by conventional stitching, sewing the like. The outer layer 52 is of attractive, elastic and flexible fabric material such as terry cloth or other wash and wear materials including knitted fabrics and the like similar to those used in jogging suits and the like which are readily launderable and constructed of various attractive colors and materials.

The layered reducing garment of the present invention may be constructed in various sizes, models and externally attractive materials so that it can be worn while exercising or in public during normal activities. The garment is durable and reduces weight by capturing body heat and retaining it interiorly of the garment thereby assisting in reducing body fat and thus body weight. The inner layer of cotton or other similar absorbent fabric will absorb perspiration and eliminate the objectionable clinging of the middle layer of vinyl to the skin surface thus rendering the garment comfortable to wear for long periods of time. The terry cloth outer layer is breatheable and may be elasticized and may be of any suitable wash and wear material with the three layers being conventionally connected together by stitching and conventional sewing techniques. The garment is easy to don and remove without tearing and causes perspiration without the wetness of the perspiration showing on the outside of the garment. The garment is easily washable and the hood may be optionally used when desired. Also, various conventional fasteners may be used for securing the components together although the hook and loop pile fastener material provides a continuity of the air and moisture imperviousness of the garment. An external pocket may be provided with a zipper opening and closing feature if desired to enable the wearer to retain possession of various desired articles. The top portion or jacket and the pants portion may be worn separately if desired and the garment may be worn for long periods of time without any harmful effects while utilizing the beneficial effects of retaining the body heat for reducing weight.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A weight reducing garment comprising a hollow flexible member adapted to enclose a portion of the human anatomy, said member including an inner layer of absorbent cotton fabric, a middle layer of air and moisture impervious flexible vinyl plastic and an outer layer of fabric to enable the garment to be worn without observation of the inner and middle layers with the inner layer absorbing body perspiration and the middle layer retaining body heat to subject the portion of the body enclosed by the flexible member to body heat, said hollow flexible member including an upper torso enclosing area and a lower pants portion with the lower end of the upper torso enclosing area being disposed externally of an upper end of the lower pants portion and the upper torso enclosing area including a hood, and sleeves and the lower pants portion including legs, flexible hook and loop pile fastener material detachable connecting the hood, sleeves and legs and detachably connecting a lower end of the upper torso area with an upper end of the lower pants portion while maintaining the imperviousness of the middle layer, the ends of the sleeves and the ends of the legs having knit cuffs thereon for snugly embracing the wrist and ankle areas of the wearer.

* * * * *